US005341989A

United States Patent [19]

Fulkerson et al.

[11] Patent Number: 5,341,989

[45] Date of Patent: Aug. 30, 1994

[54] ELECTROSTATIC POWDER SPRAY GUN WITH HOSE PURGE ADAPTOR

[75] Inventors: Terrence M. Fulkerson, Parma; Robert R. Pallante, Amherst, both of Ohio

[73] Assignee: Nordson Corporation, Westlake, Ohio

[21] Appl. No.: 17,844

[22] Filed: Feb. 16, 1993

[51] Int. Cl.[5] ..... B05B 5/025; B05B 15/02; B05B 9/01

[52] U.S. Cl. ..... 239/3; 239/112; 239/526; 239/691

[58] Field of Search ..... 239/3, 104, 106, 526, 239/690, 691, 704, 706, 707, DIG. 14, 112; 222/148

[56] References Cited

U.S. PATENT DOCUMENTS

| | | | |
|---|---|---|---|
| 3,698,644 | 10/1972 | Nystuen | 239/526 |
| 3,740,612 | 6/1973 | Gauthier et al. . | |
| 3,746,254 | 7/1973 | Duncan et al. . | |
| 3,794,243 | 2/1974 | Tamny et al. | 239/3 |
| 3,873,023 | 3/1975 | Moss et al. | 239/3 |
| 3,873,024 | 3/1975 | Probst et al. . | |
| 3,940,061 | 2/1976 | Gimple | 239/705 |
| 3,952,951 | 4/1976 | Raetz et al. | 239/705 |
| 3,964,683 | 6/1976 | Gimple | 239/691 |
| 4,139,155 | 2/1979 | Hastings | 239/708 |
| 4,193,546 | 3/1980 | Hetherington et al. | 239/112 |
| 4,248,379 | 2/1981 | Hollstein et al. . | |
| 4,302,481 | 11/1981 | Ribnitz et al. | 239/112 X |
| 4,460,126 | 7/1984 | Gates et al. | 239/112 |
| 4,534,802 | 8/1985 | Gates et al. | 239/112 X |
| 4,706,890 | 11/1987 | Talacko | 239/705 X |
| 4,747,546 | 5/1988 | Talacko | 239/704 X |
| 4,752,034 | 6/1988 | Kuhn et al. | 239/707 X |
| 4,844,348 | 7/1989 | Rutz | 239/113 X |
| 5,056,720 | 10/1991 | Crum et al. | 239/708 |

FOREIGN PATENT DOCUMENTS

| | | | |
|---|---|---|---|
| 2648487 | 4/1978 | Fed. Rep. of Germany | 239/112 |

*Primary Examiner*—Andres Kashnikow
*Assistant Examiner*—Lesley D. Morris
*Attorney, Agent, or Firm*—Rankin, Hudak & Hill

[57] ABSTRACT

An electrostatic powder spray gun includes a hose purge adapter connected in the hose line that supplies powder to the gun. The hose purge adapter is connected to a supply of purge gas and allows the powder flow path in the hose line and the powder flow path in the gun to be quickly and conveniently purged of accumulations of powder. By facilitating purging of the powder flow path, the purge adapter prevents accumulations of powder that may tend to come loose as a soft lump of powder, usually different in color, and cause an imperfection on the surface of the object being coated. The purge adapter also reduces the collections of powder in the flow path in the hose line which facilitate a grounding path by the powder, resulting in possible shocks to the operator and in a high current draw into the gun which can result in poor transfer efficiency.

14 Claims, 2 Drawing Sheets

ELECTROSTATIC POWDER SPRAY GUN WITH HOSE PURGE ADAPTOR

BACKGROUND OF THE INVENTION

1. Field of the Invention

This invention relates to electrostatic powder spraying, and more particularly to spraying dry blended powders, such as those containing mica or metallic particles, or spraying other powders containing electrically conductive material.

2. Description of the Prior Art

Various electrostatic spray coating processes and guns used for charging particles of a coating material emitted from the gun are well known. In a typical electrostatic powder spraying process, powder is conveyed in an air stream to a spray gun. The powder is electrically charged to some high voltage potential. The charging system generally operates at a potential of at least 60 kilovolts (KV). In the usual situation, electrostatic powder spray systems are used to coat electrically conductive or at least partially conductive objects. To attract the coating material to the object to be coated, the coating particles are charged to a different polarity than the object to be coated. The objects to be coated are usually held at ground voltage potential by some appropriate means. Electrostatic forces between the charged powder and the grounded conductive object cause the powder to be drawn to the object to be coated.

In order to charge the powder in an electrostatic spray coating system, it is necessary to have some means of applying the charge to the powder. Charging is usually accomplished in the spray gun by an electrode connected to a high voltage power supply. The electrode is placed in close proximity to or even in contact with the stream of powder.

Early forms of electrostatic spray guns were powered from remote high-voltage d.c. supplies that provided output voltages of 60 KV or higher. The output voltage of such power supplies was conducted via high voltage cables to particle-charging electrodes mounted near the nozzles of the guns. To provide a safe and more maneuverable gun, miniaturized voltage multiplier circuits operating at high frequency were developed that could fit within the electrostatic spray gun to produce the requisite high d.c. charging voltage from a lower input voltage. Such guns with internal high voltage multiplication capabilities are generally powered from an external low voltage power supply via a low voltage cable to the gun which is more flexible than high voltage cables. The integral high voltage circuit steps up the low input voltage by means of a transformer, rectifies and multiplies the step-up voltage in a diode/capacitor multiplier cascade, and outputs a high d.c. voltage to the particle-charging electrode of the gun.

U.S. Pat. No. 5,026,720 discloses an electrostatic spray gun construction that can be powered from an internal low voltage multiplier circuit fed from an external lower voltage source.

These apparatus and processes work well when spraying nonconductive powders and powders made of a single material. However, several problems occur with electrostatic powder spray guns when spraying dry blended powders, such as those containing mica or metallic particles. Due to the different molecular surface structure of the individual powder particles, electrostatic separation occurs. Some of these different particles accumulate on the inside of the powder flow path, attracting other like particles, and continue to build until their electrostatic charge can no longer keep them attached to the inside of the powder path. At that time, they can break off as a soft lump of powder, usually different in color, and cause an imperfection on the surface of the object being coated.

In order to prevent the undesired build-up of powder along the inside of the powder flow path, and the associated break up of accumulations of powder, the spray gun should be cleaned at frequent intervals. If the gun is not cleaned every few minutes under continuous operation, these accumulations will tend to occur. However, cleaning the gun can be a relatively time-consuming and inefficient procedure, especially if the gun must be disassembled or partially disassembled in order to clean the inside of the powder flow path.

Another problem is caused when spraying powder containing metallic particles. When spraying powders which are moderately conductive, such as metallic powders, certain precautions must be taken to prevent the high voltage at the electrode from being short circuited to ground through the column of powder being supplied to the gun. When using an electrostatic field generated by high voltage, such as 100 KV, metal particles suspended in a powder stream are close enough to each other to form a conductive chain. The voltage travels down the powder supply path looking for a neutralizing source. Unfortunately, when using hand-held powder spray guns, a neutralizing source or ground path may travel through the operator's hand, and the discharge of voltage can be irritating and somewhat painful to the operator. The formation of this facilitated grounding path by the powder can also result in a high current draw into the gun, and this high current draw can result in poor transfer efficiency.

Similar grounding problems have occurred when spraying liquid paint which is moderately conductive in electrostatic spray guns. One approach has been to isolate the entire supply from ground potential. This would allow the entire spray system to "float" at the charging potential. However, such an approach has several drawbacks. One of the major drawbacks is that an enormous amount of electrical energy would be capacitively stored in the system. This capacitively stored energy could inadvertently be discharged in a spark, causing either an electrical shock to operating personnel, or possibly causing an explosion.

Another approach has been to ground the supply container, and to connect the spray gun to the container with a hose which is long enough to make the total electrical resistance of the material column between the gun and the container large enough for moderately conductive materials, so as to reduce electrical current through the material column to a level that would not short out the electrode. However, this approach has distinct disadvantages. The supply hose in such systems would be necessarily very bulky and hard to manage when used with a hand-held gun. These hoses would have to be bulky in order to provide the necessary electrical insulation, and possibly would even include a grounded conductive layer surrounding the hose. From the operator's point of view, this approach would be very burdensome.

Another solution for isolating the circuit in liquid spray guns is shown in U.S. Pat. No. 4,139,155, in which a fluid cartridge is installed at the connection of the hose to the gun. The cartridge has an elongated spiral passage in place of the usual straight passage, presenting an increased resistive grounding path, and effectively isolating the gun from ground. While the approach of U.S. Pat. No. 4,139,155 works for liquid, it is not suitable for use with powder spray guns, since the air conveyance used with powder flow cannot be pressurized in the same way that liquid flow is. The convoluted path provided by the elongated spiral passage would provide undesirable flow resistance to the flow of the airstream containing the powder and decrease the velocity of the powder reaching the gun. As a result powder conveyance and pumping equipment currently being used would no longer be suitable, and new equipment would need to be provided.

Another solution would be to provide a ground path for the powder at the connection of the powder supply hose to the gun. Such a ground path would provide a ground path of less resistance parallel to the powder in the supply hose. However, the provision of such a low resistance grounding path could result in a high current draw into the gun, which, in effective, tends to short out the electrode. This high current draw can result in poor transfer efficiency since it makes it more difficult to impart the proper charge on the powder passing by the electrode.

SUMMARY OF THE INVENTION

The present invention overcomes the prior art problems of the accumulations of powder in the flow path of a electrostatic spray gun by providing means for easily and quickly purging the hose and the gun periodically with air. The purging means comprises an air purge adapter located in the powder supply hose line relatively remote from the gun. The air purge adapter is connected to a supply of compressed air and may be easily activated at any time to send purging air through the supply hose and through the powder flow path in the gun.

The purging means of the present invention provides an easy and convenient means for cleaning the flow stream by purging with compressed air without the necessity of disassembling or partially disassembling the gun. Using the present invention, it is possible to purge the hose and the gun frequently of accumulations of powder, such as those that accumulate when using dry blended powders containing mica or metallic particles. By purging such particles from the powder flow path before significant accumulations develop, the creation of clumps of powder in the flow path that break off and could cause imperfections on the surface of the object being coated is reduced or eliminated. Because purging can be accomplished so easily, the present invention allows purging to occur very frequently, such as between each part being coated, or every 1 or 2 minutes.

The purging of the powder flow path in the hose and the gun using the present invention also reduces grounding problems caused by the collection of powder in the supply hose. By facilitating frequent purging of the supply hose with air, accumulations of conductive powder that may collect on the inside of the hose can be easily and quickly removed.

Because the powder supply hose can be frequently cleaned by purging it with air, the portion of the supply hose near the gun may be formed of conductive tubing to provide a low resistance electrical grounding path and prevent inadvertent shocks to the operator of a hand-held gun touching the supply tubing adjacent to the gun. The use of such conductive tubing would otherwise tend to promote the accumulation of powder in the tubing, especially when using a conductive powder, but these accumulations are easily dispersed using the purging means.

These and other advantages are provided by the present invention of an electrostatic powder spray gun. The gun comprises a barrel having an electrode for charging powder and for spraying the powder, the barrel including a powder flow path therein, a hose for supplying powder to the barrel, the hose also having a powder flow path therein, and means for introducing purging air into the hose to purge the powder flow paths of the hose and the barrel of accumulations of powder.

The present invention also provides a method for electrostatic powder spraying. The method comprises the steps of attaching a hand-held electrostatic spray gun to a supply of powder using a hose line, placing within the hose line a purge adapter connected to a supply of purge gas, spraying objects with powder from the supply using the gun, and purging the hose and the gun of accumulations of powder before the accumulations build-up.

In accordance with another aspect of the present invention a purge adaptor is provided for use with a hand-held electrostatic powder spray gun. The purge adapter comprises a body having a conduit therethrough for the flow of powder with a conveying gas and an annular passageway surrounding the conduit along a portion of its length for the introduction of purge air, a first hose connection at one end of the conduit for attachment to a hose connected to a supply of powder, a second hose connection at the other end of the conduit for attachment to a hose portion for connection to the spray gun, and a third hose connection connected to the annular passageway for attachment to an air hose for connection to a supply of compressed air.

DETAILED DESCRIPTION OF THE PREFERRED EMBODIMENTS

Figure 1:
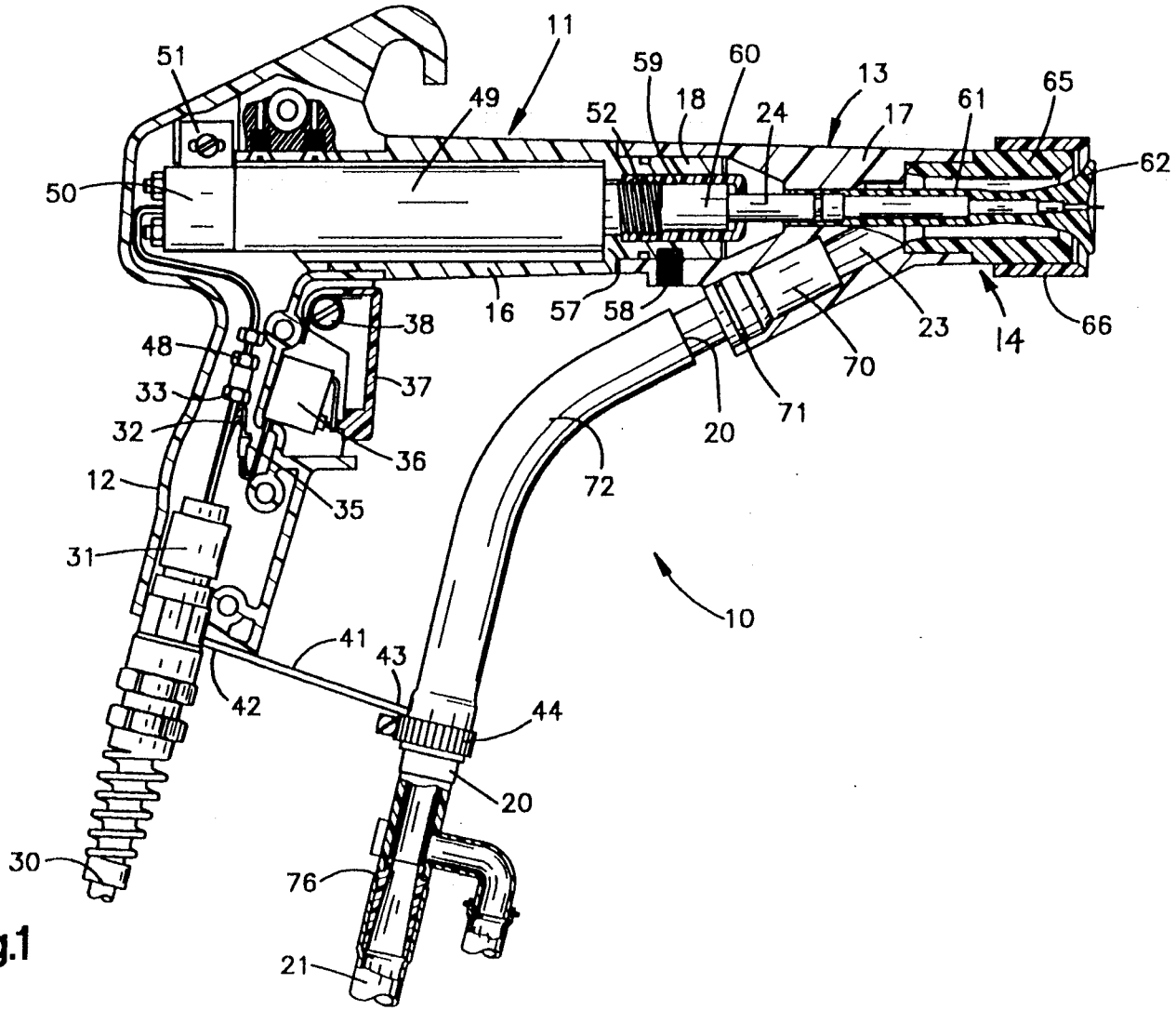
FIG. 1 is a cross-sectional side view of the gun incorporating the present invention.

Referring more particularly to the drawings and initially to FIG. 1, there is shown an electrostatic spray gun 10 which includes the present invention. The gun 10 has a pistol-shaped housing 11 comprising a handle 12 and a barrel 13 which terminates at a discharge end 14. The barrel 13 comprises a rearward section 16 and a forward section 17. The rearward barrel section 16 has a reduced diameter extension 18 at its forward end that fits with the interior of the forward barrel section 17. A hose line comprising a hose section 20 and a main hose 21 brings powder coating material to be charged into the housing 11 through an intake chute 23 formed in the forward barrel section 17 near the discharge end 14, where the powder travels through a powder flow path in the forward barrel section 17 and is charged by an electrode assembly 24.

The gun 10 is supplied with power by means of a cable 30. The end of the cable 30 is attached to a cable mounting collar 31 which has a bore extending therein into which the cable extends. The collar 31 is secured by annular flanges and recesses in an aperture at the lower end of the handle 12. The portion of the cable mounting collar 31 housed within the handle 12 is surrounded by an insulating boot (not shown) which tapers at its upper end to a narrow opening through which two groups of insulated conductors extend that terminate into a two-pin plug 32 and a three-pin plug 33. A two-pin plug 35 which mates with the plug 32 is on the end of an insulated conductor pair extending from an electrical switch The switch 36 is operated by an inverted L-shaped pivoting trigger 37 which is mounted at the free end of its base about a pivot pin 38 which is anchored to the handle 12.

The handle 12 also has a cable holder 41 in the form of an elongated flat metal plate having a rearward end 42 which is attached to the lower end of the handle by screws or the like (not shown) and a distal end 43 extending outwardly from the handle and having a hose clamp 44 which attaches to the hose section 20.

The other plug 33 mates with a three-pin plug 48 which is mounted at the end of three insulated conductors extending from the rear of an internal voltage multiplier 49 mounted within the housing 11. At the rearward end of the voltage multiplier 49, a heat conductive band 50 comprised of a band of thermally conductive material and having a tab 51 extending therefrom, is mounted for the transfer of heat generated by the voltage multiplier. The voltage multiplier 49 has a rectangular body and a telescoping threaded front end having a threaded segment 52. Another smaller threaded segment (not shown) extends from the forward end of the threaded segment 52. The electrical construction of the internal voltage multiplier 49 is generally known within the art and may include a set-up transformer, an oscillator and a capacitor/diode cascade (all not shown) to provide a high voltage d.c. output to the electrode assembly 24 from the low voltage input supplied to the internal voltage multiplier through the insulated conductor pair connected to the three-pin plug 48. The voltage multiplier 49 is mounted within the rearward barrel section 16 of the housing 11 with the forward edge of the multiplier abutting an internal wall 57 which extends transversely across the barrel interior at the transition to the extension 18. The threaded segment 52 and the other smaller threaded segment extend through an opening in the internal wall 57 and into the extension 18. The forward barrel section 17 fits over the extension 18 and grips the extension with an O-ring seal mounted within an annular groove located on the extension. The extension 18 is secured to the forward barrel section 17 by a set screw 58 or the like. A tubular retainer 59 is located inside the extension 18. The retainer 59 includes an internal threaded portion that engages the threaded segment 52 of the voltage multiplier 49.

Mounted to the forward end of the voltage multiplier 49 is the electrode assembly 24. The electrode assembly is described in more detail in U.S. Pat. No. 5,026,720. The electrode assembly 24 comprises a rearmost segment 60 having an internal threaded opening for receiving the forwardmost smaller threaded segment of the voltage multiplier 49.

The forward end of the electrode assembly 24 extends from an opening in the forward end of the retainer 59 and extends into the forward barrel section 17. The electrode assembly 24 extends through a tubular deflector stem 61 which has a sloping nose at its forward end. A deflector 62 is mounted on the forward end of the electrode assembly 24 that extends from the forward end of the deflector stem 61.

A nozzle 65 fits on the end of the forward barrel section 17 and surrounds the forward end of the electrode assembly 24 and the deflector 62. The rearward end of the nozzle 65 fits inside the forward end of the barrel section 17, and an O-ring seal located in an annular groove in the rearward end of the nozzle 65 holds the nozzle in place at the forward end of the barrel section 17. A ring 66 fits around the outside of the nozzle 65.

A powder flow path is thus formed in the barrel 13 of the gun 10 by the forward barrel section 17 and the nozzle 65 with the electrode assembly 24 therein covered by the deflector stem 61 and the deflector 62.

Powder is supplied to this powder flow path through the material intake chute 23 which extends from the lower side of the forward barrel section 17. A hose adapter 70 is held at one end within the material intake chute 23 by an O-ring seal 71. The other end of the hose adapter 70 is attached to the upper end of the hose section 20 which fits over the lower end of the hose adapter. The hose section 20 is, of course, hollow and provides a powder flow path therein for the supply of powder to the gun 10. The hose section 20 extending from the material intake chute 23 is sheathed in a conductive tubing 72. The hose section 20 extends to the distal end 43 of the cable holder 41 where it is attached to the cable holder by the hose clamp 44 which is wrapped around the lower end of the conductive tubing 72.

The conductive tubing 72, the hose clamp 44 and the cable holder 41 together provide a low resistance grounding path for the gun which reduces the incidence of shocks to the operator's hand holding the handle 12 and actuating the trigger 37. However, the presence of the conductive tubing 72 also promotes the accumulation of conductive powder in the hose section 20 since powder is attached to it. The accumulation of powder within the hose section 20 may reduce the electrical resistance in the grounding path and tend to short out the gun.

Figure 2:
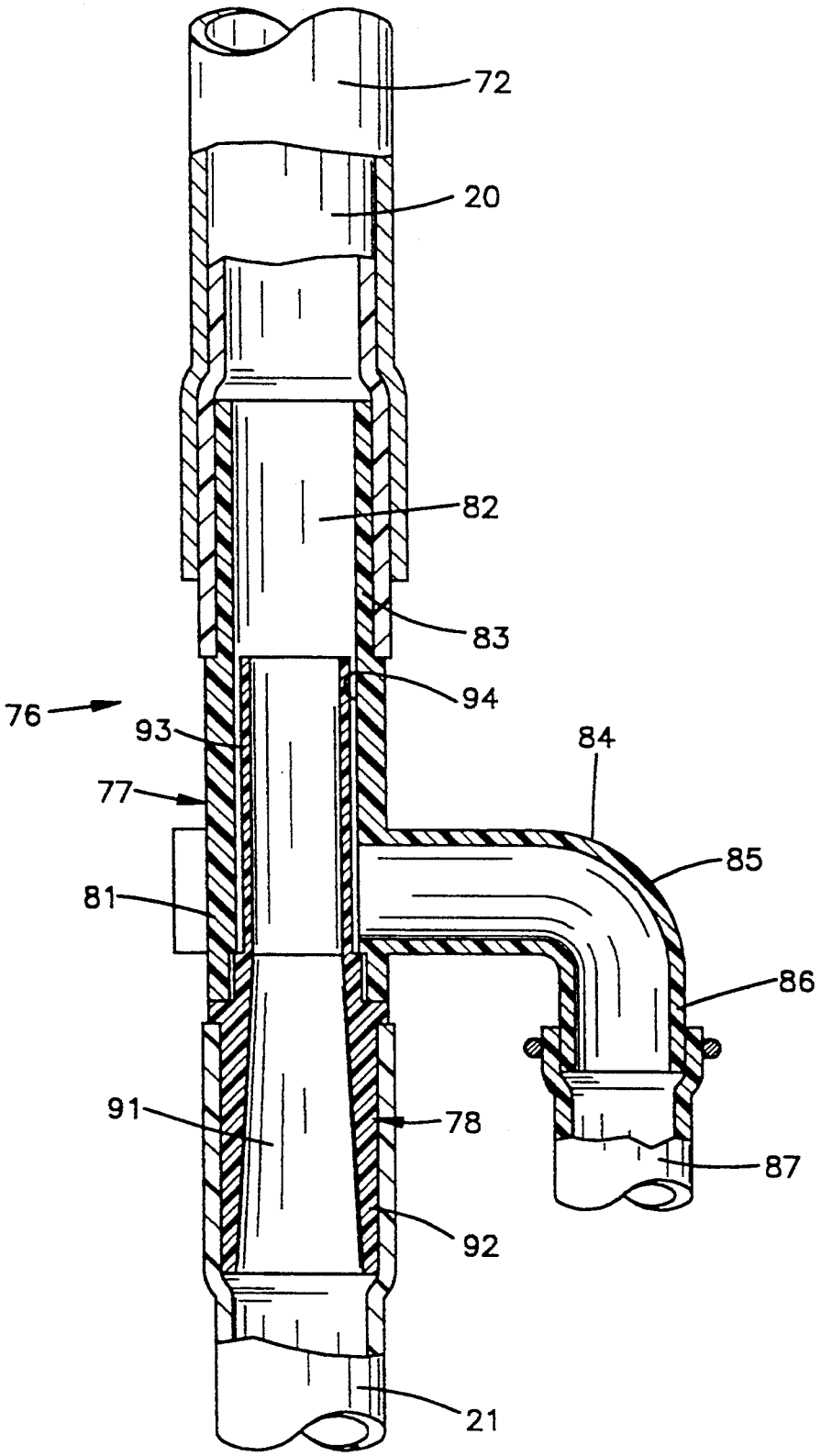
FIG. 2 is a detailed cross-sectional view a portion of FIG. 1 to a larger scale.

To allow for easy frequent cleaning of the flow path in the hose section 20 as well as to permit the flow path in the gun 10 to be purged of accumulations of powder, a hose purge adapter 76 is provided in the hose line, attached to the lower end of the hose section 20 just below the position of the cable holder 41. The hose purge adapter 76 is supported by the hose clamp 44 which clamps around the adapter and around the hose section 20 on its upper end. The hose purge adapter 6 attaches the hose section 20 to the main hose 21 and is shown in more detail in FIG. 2. The purge adapter 76 comprises an outer member 77 and an inner member 78, both made of an electrically non-conductive material.

The outer member 77 includes a hollow central body 81 having channel 82 therethrough for the flow of powder. The outer member 77 terminates with a hose connecting portion 83 at one end. The hose section 20 from the gun 10 is connected to the connecting portion 83 with the conductive tubing 72 fitting over the hose section and held in place by the hose clamp 44. The outer member 77 also includes an air conduit portion 84 which extends laterally from the body 81. The air conduit portion 84 has an internal passageway for providing a flow of purge air to the purge adapter 76. The air conduit portion 84 includes an elbow 85 and terminates at a connection 86 for an air hose 87. The air hose 87 is connected to a suitable supply of compressed air (not shown). Suitable valving means (not shown) are provided to selectively regulate the supply or compressed air to the purge adapter 76 as desired.

The inner member 78 of the hose purge adapter 76 includes a central channel 91 for the flow of powder. The channel 91 terminates at a hose connecting portion 92 to which the main hose 21 connected to the pumping means is attached. The inner member 78 also has a small diameter portion 93 opposite the hose connecting portion 92 which extends into channel 82 in the body 81 of the outer member 77. The outer diameter of the portion 93 is smaller than the inner diameter of the channel 82 in the outer member body 81, providing an annular passageway 94 between the inner and outer members for the flow of air supplied from the air hose 87. The air from the annular passageway 94 enters the channel 82, flows through the powder flow path in the hose section 20, and flows through the powder flow path in the barrel of the gun 10.

In the operation of the present invention, the spray gun 10 is operated in accordance with conventional procedures to electrostaticly spray power supplied to the gun through the hose 21. When spraying dry blended powders, electrostatic separation may occur due to the different molecular surface structure of the individual powder particles. Some of these different particles will accumulate on the inside of the powder flow path within the gun 10. The accumulated particles will attract other like particles, and they will continue to build. If allowed to build up in this matter, the accumulated particles would continue to build until the electrostatic charge could no longer keep them attached to the inside of the gun, and they would break off as a soft chunk of powder, causing an imperfection on the surface of the part being coating.

Before this accumulation is allowed to build up, spraying of the powder is halted temporarily, and the flow of compressed air through the air hose 87 is initiated. The air from the air hose 87 flows into the flow path in the hose section 20 through the hose purge adapter 76 and flows through the flow path in the gun 10, purging the flow path of undesirable build up of accumulated particles. After the air purge is completed, the air supply is turned off, and electrostatic powder spraying can continue. To prevent undesirable powder particle accumulation in the gun, the gun should be purged at frequent intervals, such as between parts which are being powder coated or after every 1 to 2 minutes of spraying.

The air purge also has the effect of clearing any build up of accumulated powder in the flow path in the hose section 20. When spraying with powders containing conductive material, such as metal particles, this build up could provide a conductive path to ground through the powder in the hose section 20. The voltage would travel down the powder path looking for a neutralizing source. The proximity of the operator's hand, gripping the handle 12 with fingers on the trigger 37 makes this a dangerous situation. This unintentional grounding could also result in a high current draw into the gun and cause poor transfer efficiency. Periodic purging of the flow paths in the hose section 20 and the gun 10 by introducing purge air through the hose purge adaptor 76 will blow away undesirable accumulations of powder in the hose section that could provide a grounding path, resulting in safer and more efficient operation of the gun. In addition, the conductive tubing 72 placed over the hose section 20 provides a ground path for any excess charge through the hose clamp 44 and the cable holder 41, avoiding any grounding through the operator's hand.

Instead of grounding the powder flow path through the hose clamp 44 and the cable holder 41, it is also possible to use the hose purge adapter 76 as part of the grounding path. The outer member 77 of the hose purge adapter 76 can be made from a conductive material such as brass, aluminum or carbon-impregnated plastic. The outer member 77 can then be connected to ground by attaching a suitable ground connection to it. The hose purge adapter would then provide the necessary path for the voltage to discharge.

While the invention has been shown and described with respect to a hand-held spray gun 10, the advantages of the invention can also be realized with automatic spraying apparatus. The problems of shock to the operator are not present with automatic spraying equipment, but the other problems of the accumulations of powder in the flow path occur in such equipment causing imperfections in the surface of the part being sprayed, high current draw into the gun, and poor transfer efficiency. Therefore, the invention shown and described should not be limited to hand-held spraying equipment and may be advantageously used in other powder spraying equipment.

Other variations and modifications of the specific embodiments herein shown and described will be apparent to those skilled in the art, all within the intended spirit and scope of the invention. While the invention has been shown and described with respect to particular embodiments thereof, these are for the purpose of illustration rather than limitation. Accordingly, the patent is not to be limited in scope and effect to the specific embodiment herein shown and described nor in any other way this is inconsistent with the extent to which the progress in the art has been advanced by the invention.

What is claimed is:

1. A method for electrostatic powder spraying, which comprises the steps of:

attaching a hand-held electrostatic spray gun having a handle to a supply of powder using a hose line;

placing within the hose line below the handle a purge adapter connected to a supply of purge gas;

spraying objects with powder from the powder supply using the gun; and purging the hose line and the gun of accumulations of powder before the accumulations build-up.

2. The method for electrostatic powder spraying of claim 1, comprising the additional steps of halting spraying before purging the hose line and the gun, and resuming spraying after purging is completed.

3. The method for electrostatic powder spraying of claim 1, where the purging step is performed by actuating the supply of purge gas through the purge adapter.

4. A hand-held electrostatic powder spray gun, which comprises:

a barrel and means for charging powder and means for spraying the powder, the barrel including a powder flow path therein;

a handle connected to the barrel for holding the spray gun in the hand of a user;

a hose line for supplying powder to the barrel, a portion of the hose line extending adjacent to the handle, the hose line having a powder flow path therein; and means located in the hose line below the handle for introducing purging air directly into the hose line to purge the powder flow paths in the hose line and the barrel of accumulations of powder.

5. The electrostatic powder spray gun of claim 4, comprising in addition means for supporting the hose line between the handle and the barrel, the introducing means located in the hose line upstream of the supporting means.

6. The electrostatic powder spray gun of claim 5, comprising in addition a bracket attached to the handle, the hose line being supported by the bracket.

7. The electrostatic powder spray gun of claim 6, wherein a portion of the hose line is electrically conductive, the bracket is electrically connected to ground, and the hose line portion is electrically connected to the bracket to provide a grounding path.

8. The electrostatic powder spray gun of claim 4, wherein a portion of the hose line is electrically conductive to provide a grounding path for the gun.

9. The electrostatic powder spray gun of claim 8, wherein the hose line portion is electrically connected to grounding member.

10. The electrostatic powder spray gun of claim 9, wherein the grounding member is attached to the spray gun.

11. The electrostatic powder spray gun of claim 4, wherein the introducing means comprises a hose purge adapter connected in the hose line.

12. The electrostatic powder spray gun of claim 11, wherein the adapter is spaced away from the barrel.

13. The electrostatic powder spray gun of claim 11, wherein the purge adaptor comprises a body having a conduit therethrough for the flow of powder with a conveying gas, and an annular passageway surrounding the conduit along a portion of its length for the introduction of purge air;

a first hose connection at one end of the conduit for attachment to a first portion of the hose line connected to a supply of powder;

a second hose connection at the other end of the conduit for attachment to a second portion of the hose line for connection to the spray gun; and a third hose connection connected to the annular passageway for attachment to an air hose for connection to a supply of compressed air.

14. A purge adapter for use with a hand-held electrostatic powder spray gun comprising:

a body comprising an inner member and an outer member, a channel through the body for the flow of powder with a conveying gas, a passageway formed between the inner member and the outer men, her for the introduction of purging air into the channel, the passageway being annular and surrounding the channel along a portion of its length;

a first hose connection formed on the inner member at one end of the channel for attachment to a supply of powder;

a second connection formed on the outer member at the other end of the channel for attachment to the spray gun; and a third connection connected to the passageway for attachment to a supply of purging air.

* * * * *

UNITED STATES PATENT AND TRADEMARK OFFICE

CERTIFICATE OF CORRECTION

PATENT NO. : 5,341,989

DATED : August 30, 1994

INVENTOR(S) : Terrence M Fulkerson & Robert R. Pallante

It is certified that error appears in the above-indentified patent and that said Letters Patent is hereby corrected as shown below:

Column 5, line 8, after "switch" insert --36.--

Column 6, line 49, delete "6" and insert --76--

Claim 14, line 23 delete "men, her" and insert --member--

Signed and Sealed this

Fifteenth Day of November, 1994

*Attest:*

Bruce Lehman

BRUCE LEHMAN

*Attesting Officer*

*Commissioner of Patents and Trademarks*